US006729169B2

(12) United States Patent
Moore

(10) Patent No.: US 6,729,169 B2
(45) Date of Patent: May 4, 2004

(54) DUAL CYLINDER DEADBOLT ADJUNCT

(76) Inventor: Randall L. Moore, 1059 Dulin Dr., Amissville, VA (US) 20106

( * ) Notice: Subject to any disclaimer, the term of this patent is extended or adjusted under 35 U.S.C. 154(b) by 0 days.

(21) Appl. No.: 10/103,846

(22) Filed: Mar. 25, 2002

(65) Prior Publication Data

US 2002/0166354 A1 Nov. 14, 2002

Related U.S. Application Data

(60) Provisional application No. 60/278,734, filed on Mar. 27, 2001.

(51) Int. Cl.[7] ..... E05B 13/00

(52) U.S. Cl. ..... 70/472; 70/149; 70/218; 70/224; 70/379 R; 70/DIG. 60

(58) Field of Search ..... 70/467, 468, 471, 70/422, 472, 224, 149, 218, 221, 222, 379 R, 379 A, DIG. 70; 292/DIG. 27

(56) References Cited

U.S. PATENT DOCUMENTS

| | | | | |
|---|---|---|---|---|
| 354,472 A | * | 12/1886 | Hitt | |
| 891,562 A | * | 6/1908 | McPherson | |
| 1,243,518 A | | 10/1917 | Harvey | |
| 1,535,393 A | * | 4/1925 | Ballbach | |
| 1,864,358 A | * | 6/1932 | Kerwin, Jr. | |
| 2,207,801 A | * | 7/1940 | Harp | |
| 2,617,290 A | | 11/1952 | Schwartz | |
| 2,658,151 A | | 11/1953 | Heinz | |
| 2,923,145 A | * | 2/1960 | Labrie | |
| 3,500,669 A | * | 3/1970 | Bardfeld | |
| 4,028,917 A | | 6/1977 | Schlage | 70/389 |
| 4,068,510 A | | 1/1978 | Neary | 70/379 R |
| 4,109,496 A | | 8/1978 | Allemann et al. | 70/380 |
| 4,142,748 A | * | 3/1979 | Hook | 292/169.15 |
| 4,228,669 A | | 10/1980 | Bischoff | 70/379 R |
| 4,315,420 A | | 2/1982 | Oliver | 70/379 R |
| 4,572,556 A | * | 2/1986 | Foshee | 292/165 |
| 4,736,970 A | * | 4/1988 | McGourty et al. | 292/359 |
| 4,914,554 A | | 4/1990 | Sowers | 70/455 X |
| 5,140,843 A | | 8/1992 | Krueger | 70/429 |
| 5,615,567 A | | 4/1997 | Kemp | 70/455 |
| 5,826,924 A | * | 10/1998 | Huang | 292/359 |
| 5,950,467 A | * | 9/1999 | Dong | 70/467 |
| 6,145,358 A | * | 11/2000 | Wu | 70/467 |

FOREIGN PATENT DOCUMENTS

| | | | | |
|---|---|---|---|---|
| DE | 169151 | * | 3/1905 | 70/471 |

* cited by examiner

*Primary Examiner*—Lloyd A. Gall
(74) *Attorney, Agent, or Firm*—Cahn & Samuels, LLP

(57) ABSTRACT

A deadbolt manipulation adjunct and method that provides user selection between dual cylinder, single cylinder, and disabled modes, is capable of retrofitting on existing deadbolt structures, which maintains full deadbolt security while providing authorized user deadbolt operation between locked and unlocked positions via a thumb turn actuator to release the deadbolt in the case of an emergency.

6 Claims, 3 Drawing Sheets

FIG. 7
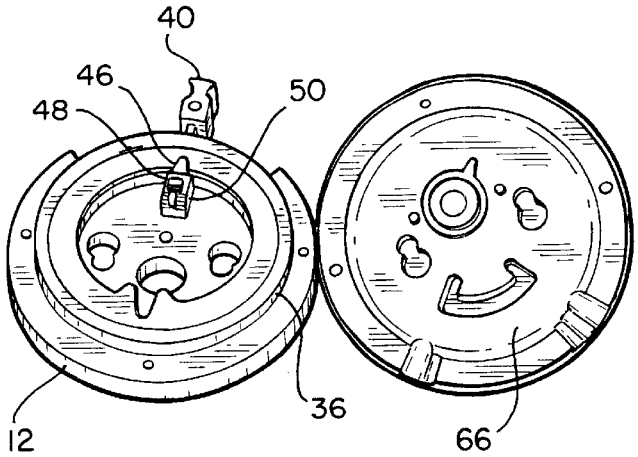
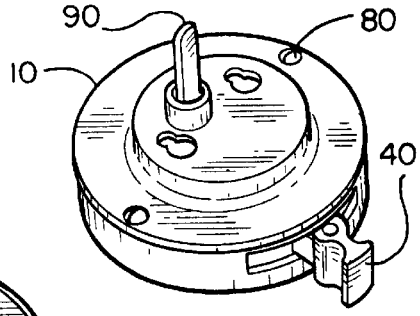
FIG. 5
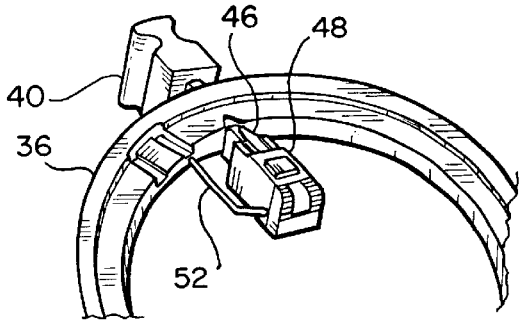
FIG. 8
FIG. 6
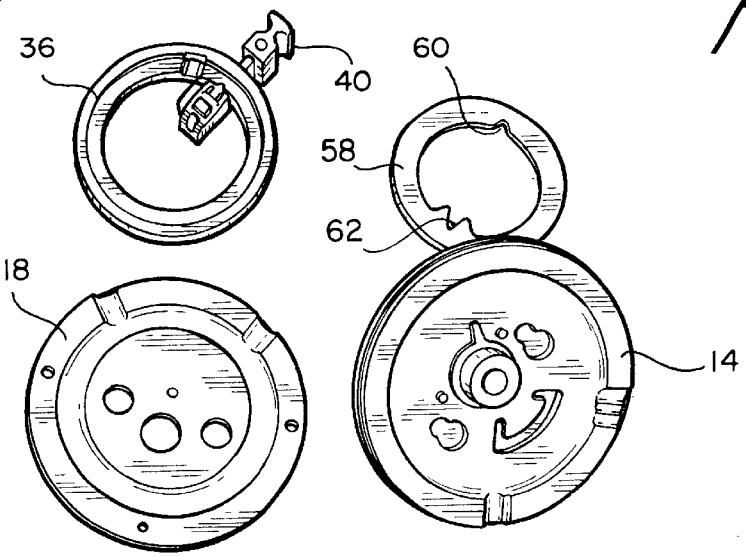

DUAL CYLINDER DEADBOLT ADJUNCT

I. TECHNICAL FIELD

The present invention relates to a long felt but unsatisfied need for improvement in use of high security deadbolt devices. More particularly, the invention herein describes a structure and method for association with conventional single or double cylinder deadbolts (two keys) that permit a person on the inside to release or reengage the deadbolt by use of a thumb lug.

II. BACKGROUND OF THE INVENTION

Deadbolt assemblies including single and dual cylinder deadbolt mechanisms are well known security adjuncts. Single cylinder deadbolt mechanisms are normally key-operated from the outer side of the door to translate the deadbolt from the lock recess, with a thumb turn provided on the inner side of the door.

Double cylinder deadbolt mechanisms do not have the interiorly disposed thumb-turn associated with the single cylinder assemblies and rely, instead, on insertion and rotation of a key to translate the bolt. Double cylinder deadbolts are prohibited in certain jurisdictions as a result of the hazard created from the inability of an authorized person to escape from the interior of a structure in emergency events such as a structural fire. Such issues are specifically addressed in the patent literature such as in Oliver, U.S. Pat. No. 4,315,420, which discloses a retained key, double cylinder deadbolt assembly. The patent literature also contains some unusual solutions to retrofit and essentially disable existing dual cylinder deadbolts where such locks have been outlawed subsequent to installation. One such device is described in U.S. Pat. No. 5,140,843, which, in effect, clads a key located in the interior cylinder of a dual cylinder lock within plates to convert the key into a permanent thumb lug but correspondingly eliminate the security benefit provided by a double cylinder deadbolt.

A double cylinder deadbolt offer greater security on doors, particularly those incorporating glass panels, because it requires the insertion of a key for operation to unlock a latched deadbolt even from the inside. This provides a security advantage by preventing egress by unauthorized persons carrying stolen material through the door, e.g., preventing large items from being removed through the locked door during a robbery. This security advantage, however, turns into a disadvantage in the case of an emergency such as a fire. In such a case, a latched dual cylinder deadbolt may delay egress and, thus, prevent escape in the event of an emergency. This risk is magnified in the case of an elderly, infirmed, or physically disabled individual. To address this problem, conventional wisdom recommends that the owner maintain the interior key in the interior cylinder (thereby defeating the dual cylinder function) or locate a hidden key proximate to the door for use in emergencies. Obviously, security advantages provided by a double cylinder deadbolt are compromised in such a case.

In view of the less than universal acceptance of dual cylinder deadbolt assemblies, most installers follow regulations and substitute single cylinder deadbolts in favor of dual cylinder deadbolts. As noted, single cylinder deadbolts avoid obstructing easy egress from a premise during a fire or other emergency. However, that advantage requires sacrifice of protection on doors or where the lock is proximate to a glass panel or a door is formed of glass.

While some of the foregoing difficulties have been referred to in the patent literature, no practical solution has been offered to overcome problems associated with dual cylinder deadbolts. None of the structures disclosed in the patent literature contemplate the effective preservation of security of a double cylinder deadbolt lock while providing a plurality of user selective egress modes based on simple physical manipulation.

What is needed in the art of authorized manipulation of deadbolts particularly facilitating escape in the case of a true emergency, is a simple, easily operated, effective, universal, user selective egress mode system and method that may be integral with new manufacture or retrofittable conversion.

III. SUMMARY OF THE INVENTION

It is an object of this invention to provide a cylinder type deadbolt assembly overcoming the problems with the prior art.

It is another object of this invention to provide a deadbolt adjunct that is at once secure, effective, inexpensive and easily incorporated on newly manufactured deadbolt products or retrofittable to existing products.

It is an object of the invention to provide a rotatable digit driven lug that releases a deadbolt from the locked position.

It is a further object of this invention to provide an adapter for simple convertibility of conventional double cylinder deadbolt assemblies to meet the objective of the invention to reduce effort required for authorized release of the deadbolt in the event authorized egress is desired.

A further object of this invention is to provide an assembly for adapting a deadbolt thumb latch to double cylinder deadbolts.

Still a further object of this invention is to provide a method for emergency deadbolt release.

A further object of this invention is to provide an apparatus and method permitting conversion in a minimum of time of conventional double cylinder deadbolt structures to an egress facilitating structure without compromising security.

These and other objects of the invention are satisfied by a combination of

- a dual cylinder dead bolt and a dual cylinder dead bolt adjunct permitting selective keyless operation.

Still other objects of the invention are provided by a method of opening a door having a dual cylinder deadbolt with a translatable deadbolt and a dual cylinder deadbolt adjunct of the type depicted and described herein, including the steps of:

- inserting an authorized opening means such as a key into the deadbolt;
- detenting a manipulation means such as a physical thumb latch into an engaging position to transfer motion from the manipulation means to the deadbolt latch;
- removing the opening means; and
- moving the manipulation means to translate the deadbolt.

The invention herein, referred to as DCDA (double cylinder deadbolt adjunct), in practice, allows a user to select one of three operative modes of a double cylinder deadbolt. In order for a user to select the mode of operation, the user must be authorized, e.g., be in possession of a key. Only with the key inserted can the user change the mode of the actuator operation.

The user may select in one mode to retain the full operability of the double cylinder deadbolt or may select to rely on a single cylinder modality for egress. The DCDA permits the user to select and change the functionality at any time, so long as the user inserts the proper key/key card, electronic key/remote, etc. Where the user selects to set the adjunct by manipulation of the actuator (a collar, lever or button, etc.) to a single cylinder mode, the dual cylinder deadbolt, in essence is converted to a single cylinder deadbolt where the deadbolt may be retracted or engaged by physical manipulation of the actuator. Being operatively disposed on the inside of the door, the actuator is typically associated with the periphery of the deadbolt's interior lock portion. Also, when radially depressed, the DCDA can be rendered non-functional which leaves the door unlocked unless the proper key is inserted and the mode changed by the user.

Thus, the invention provides for three basic operative modes; double cylinder, single cylinder, and DCDA disabled mode.

The outer/exterior cylinder controls the function of the DCDA. Upon exiting a premises, an authorized user may want to engage the deadbolt but allow for easy egress by a person on the inside who may unlocked the deadbolt without use of the key (e.g. single cylinder mode). Thus, any occupant may retain the enhanced security provided by a deadbolt while permitting others properly on the premises to exit the door in the case of an emergency. On the other hand, if the person wishes to employ the deadbolt in its fully secure mode, by setting the DCDA to its double cylinder operative mode prevents unlocking of the door without the key.

Preferably the DCDA includes an indicator, to indicate the status of the associated deadbolt. The indictor may be mechanical or electronic and will clearly indicate the current operative mode of the deadbolt, e.g., single cylinder or double cylinder. Preferably, the indicator also shows whether the deadbolt is locked or unlocked.

The invention herein is useful in deadbolt security involving a wide range of particular structures, either new or retrofit. In keeping with the objectives, the invention is both simple and easily deployable. Based on its capabilities, the invention herein is readily operational in conjunction with virtually any double cylinder deadbolt structure while providing the necessary manipulability of a thumb turn by an authorized individual from the interior side.

In part, owing to its ability to provide easy unlatching of a deadbolt, the invention reduces the hazard of injury to the person from a hostile setting from the interior, e.g. fire, or attack. Consequently, the invention is readily adaptable and effective at minimal cost and installation.

As used herein in additional to conventional dictionary definitions, the following may be used in connections with the associated terms.

Single Cylinder Deadbolt: A deadbolt lock which operates with manipulable element (typically a thumb turn) on the interior and a keyed cylinder on the outside of the door. A single cylinder deadbolt is generally used on a door that does not include an obvious weakness, e.g., glass panels.

Double Cylinder Deadbolt: A deadbolt lock which operates with a keyed cylinder on both sides of the door. A double cylinder deadbolt is generally used on a door that has glass on or around it. Thereby preventing someone from breaking the glass and reaching inside to open the door~there been a single cylinder deadbolt installed.

The foregoing and other objects and advantages will appear from the description to follow. In short, the invention herein, is directed particularly to a convertible, manually operable double cylinder deadbolt adjunct providing for selectivity of three operative modes. In the description, reference is made to the accompanying drawing which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

IV. BRIEF DESCRIPTION OF THE DRAWINGS

FIG. 5 is a digitized photographic image of a prototype embodiment according to the present invention.

FIG. 6 is a digitized photographic image of the unassembled components of the prototype embodiment depicted in FIG. 5.

FIG. 7 is a digitized photographic image of partially assembled components of the prototype embodiment depicted in FIG. 5.

FIG. 8 is a digitized photographic image of the outer disk and thumb turn of the prototype embodiment depicted in FIG. 5.

V. DETAILED DESCRIPTION OF THE ILLUSTRATED EMBODIMENT

Figure 1:
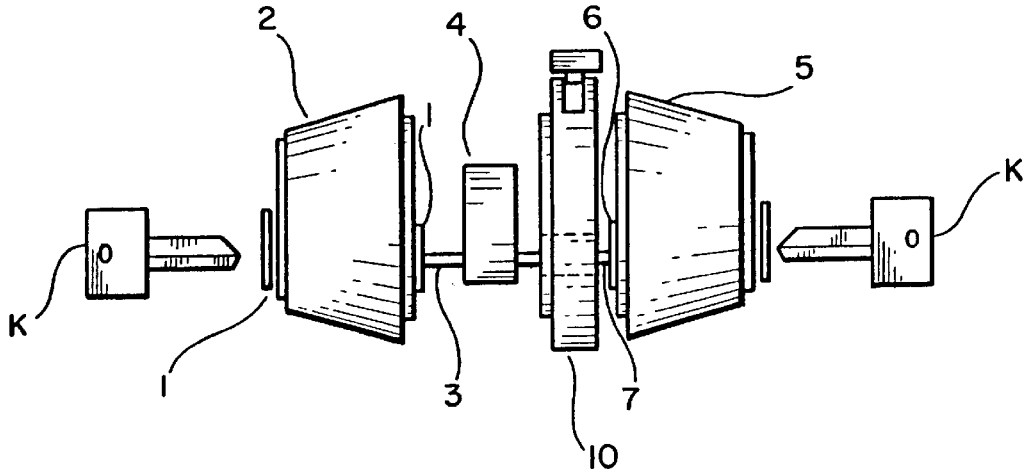
FIG. 1 is an assembly side view of one embodiment of the invention.

Referring now to the figures and, in particular, to FIG. 1, an embodiment of the invention is illustrated in combination with a conventional double cylinder deadbolt assembly comprising an exterior conical outer cylinder cover 2 which surrounds a key actuated outside cylinder 1. A planar cylinder tailpiece 3 projects from the back of the cylinder and transmits rotational force to a camming element associated with reciprocating deadbolt latch 4. Interposed between the interior door surface and the interior conical outer cylinder cover 5 surrounding a key actuated interior cylinder 6 is an adjunct device 10. In this embodiment, the adjunct does not feature a tailpiece but instead accommodates and uses the floating cylinder tail piece 7 of the interior cylinder where the tail piece passes through a slot in the spindle of the adjunct 10. The tail piece 7 extends to the latch mechanism to communicate rotational force from the cylinder to a camming element associated with the latch 4.

Figure 2:
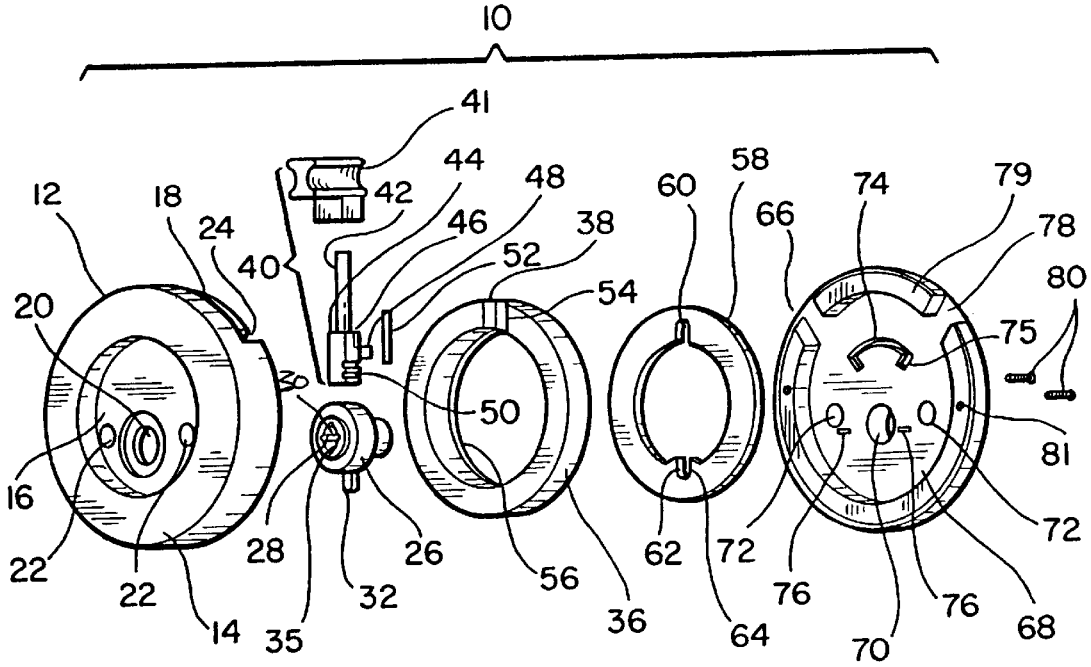
FIG. 2 is an exploded, perspective view of a first embodiment of the invention.

In FIG. 2 there is shown an exploded view of a double cylinder deadbolt adjunct 10 according another embodiment of the invention. This embodiment of figure comprises a machined metal top cover 12 including an annular ring 14 surrounding a generally flat circular center 16. The outer peripheral surface of the ring 14 incorporates a cutout 18 of a selected arc. The circularly disposed cutout 18 also includes a radially disposed dogging slot 24. The center portion 16 features a spindle hole 20 adapted to receive and secure a drive cam 26 and a pair of through bolt holes 22 disposed on either side of the spindle hole 20 and positioned to receive and retain the securing bolts of an associated deadbolt assembly. For retrofit applications, preferably those holes are dimensioned to accommodate a range of the most common commercially available double cylinder deadbolt units.

A drive cam 26 is rotatably mounted where the drive cam includes a slot insert 28 including a floating tailpiece hole 30. The drive cam also features a radially disposed rotational limit pin 32. A detentable thumb turn 40 depicted in FIG. 2 is affixed to an outer disk 36 via a radial slot 38 in which it may translate radially. The thumb turn 40 features a manipulation button 41 mounted on spindle 42 and is adapted to move through the arc defined by the cutout 18. An elongated thumb turn button 41 is attached to the spindle 42 with a set screw (not illustrated). The spindle 42 is affixed to a spindle base 44 which incorporates a radially extending engagement lug 46, an axially extending inner disk engagement pin 48, and a pair of spring detent slots 50. The detent slots 50 are adapted to receive and frictionally retain a bent detent spring 52 which is affixed by brazing or other appropriate means within a slot 54 formed in the outer disk 36. Preferably, the position of the spring slot 54 is proximate to the thumb turn spindle slot 38. In this manner, the spring 52 is retained in the inner disk slot and resists radially directed movement of the thumb turn 40 from the spring detent slot 50 in which it is detented until subject to sufficient translational force to dislodge the spring therefrom.

Formed on the backside of the outer disk 36 is a radially inset annular raceway 56 dimensioned to receive and secure the inner disk 58. The inner disk 58 is a flat ring-like element that features a thumb turn notch 60 and a driver cam pin slot 62, oppositely disposed along the disk's inner edge. The dimension of driver pin slot 62 is selected to receive the drive pin 32 of the drive cam reinforced by the enlarged sides 64 to prevent undesirable disengagement of the pin from the slot. The bottom/back cover 66 of the adapter is generally circular and corresponds to the diameter of the top cover 12. The back cover 66 features a central portion 68 that includes a drive cam spindle hole 70 corresponding to the spindle hole 20 of the top cover and a pair of through bolt holes 72 corresponding in dimension and purpose to those of the holes 22. The illustrated center portion 68 also includes an arcuate generally C-shaped slot pin slot 74 including two radially aligned legs 75. The pin slot 74 receives and guides the thumb turn engagement pin 48. Thus, the engagement pin 48 may travel in an arc as well as detenting radially along the length of the legs 75.

Two axially and interiorly (relative to the DCDA) directed 76 dogging pins project axially from the interior surface of the central portion 68 and proximate to a drive cam receiving spindle hole 78. The two pins 76 correspond to the arc of the dogging slot 74 (and slot 18 in the top cover). Accordingly, the degree of permitted rotation of the drive cam pin 32 is limited to the same arc corresponding to that of the thumb turn within the dogging slot 18.

Finally, an interiorly disposed, discontinuous, annular lug 79 is disposed about the periphery of the interior face of the bottom cover 66. The lug forms a substantial circumferential annular ring incorporating two discontinuities 78 corresponding to the arcuate boundaries of the dogging slot 74 and matching the slot 18 formed in the top cover. Unlike the first embodiment, the second embodiment does not include its own tailpiece associated with the spindle but relies on the tailpiece of the original deadbolt. In other words, the second embodiment lends itself readily to retrofitting on existing deadbolts.

The entire assembly is screwed together with conventional flat headed machine screws 80 threaded into axially machined threaded bores 81 extending through the annulus of the bottom cover and into the top cover.

Figure 3:
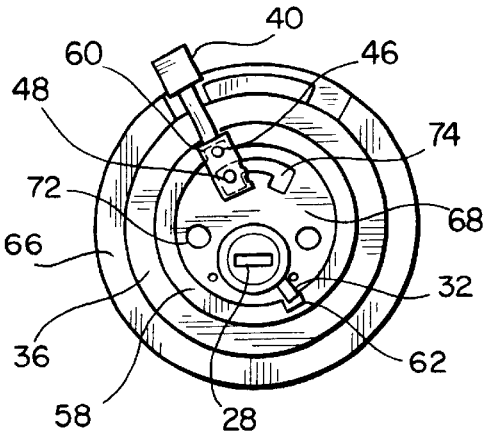
FIG. 3 and FIG. 3A are assembly views of components of an embodiment of the invention in a single cylinder mode in the latched and unlatched positions, respectively.
Figure 3A:
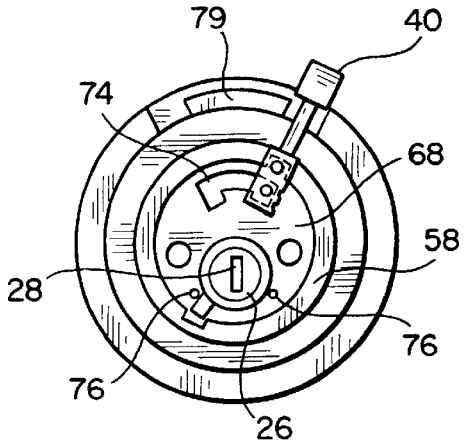

Referring to FIGS. 3 and 3A, they represent the invention permitting the deadbolt to be operated as in a single cylinder mode. The thumb turn 40 is in a radially extended position, thus, riding above annulus 79 where it is rotatable. In this case, the rotation for the thumb turn 40 is through a nearly 90° arc corresponding to the arcuate length of the dogging slot 18. The engagement pin 48 is seated in the slot 60 so that rotation of the thumb turn imparts direct rotation to the inner disk which is in a camming contact with spindle drive cam pin 32. Thus, clockwise rotation of the thumb turn rotates the spindle and tailpiece hole 3. The tailpiece, accordingly, rotates which translates the associated deadbolt. The DCDA can also be designed in such a way that it defaults to single cylinder mode when the deadbolt is unlocked while it was in double cylinder mode.

Figure 4:
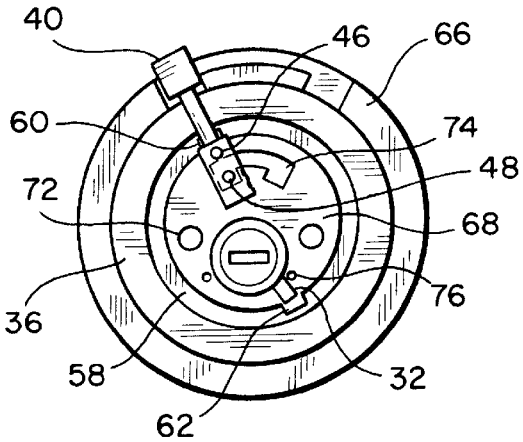
FIG. 4 and FIG. 4A are assembly views of components of an embodiment of the invention in a double cylinder mode in the latched and unlatched positions, respectively.
Figure 4A:
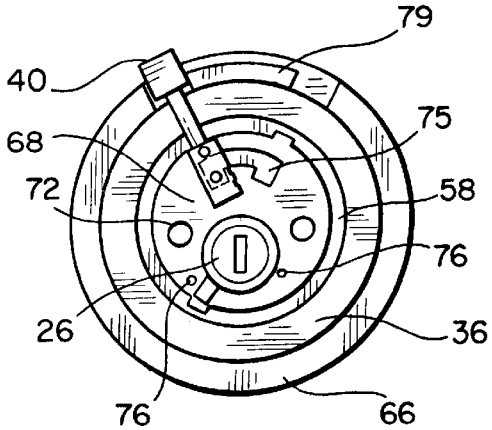

Referring to FIGS. 4 and 4A, they represent the thumb turn 40 in a (radially depressed, non-actuating mode. In this mode, the thumb turn is constrained by the annulus 79, the engagement lug is disengaged from the slot 60, and the engagement pin is nested in a radially extending leg of the C-slot 74. Consequently, the thumb turn 40 is disengaged from the inner disk 58 and the disk 58 rotates independently of the thumb turn 40. The only way to impart rotational force to the spindle 26 and to translate the associated deadbolt, therefore, is through the use of a key.

Another function can be derived from this device by allowing the DCDA to be manipulated while in the locked position before it is disengaged by a key. That is by rotating the DCDA to the locked position, and then disengaging it from the drive cam by rotating the key to the unlocked position, the thumb turn is locked in place, thereby disabling and preventing the deadbolt from being locked unless a key is used to return it to its normal position.

FIGS. 5, 6, 7, and 8, depict a physical prototype of and embodiment of the invention. This depicted embodiment of the invention incorporates its own tailpiece 90. When the DCDA Thumb Turn is rotated in the locking direction, its engagement with the internal cam causes the auxiliary device tailpiece to rotate the cam inside of the associated deadbolt latch which extends the deadbolt to the locked position. Simply by rotating the thumb turn in the opposite direction causes the latch to retract.

In order to select double cylinder operation, the thumb turn engagement lug must be disengaged from the inner disk. In this mode the deadbolt may be locked or unlocked, whether inside or outside but only with a key. Setting the deadbolt to operate in single cylinder mode is accomplished by inserting and turning either the inside or the outside key from the locked position to the unlocked position. The internal cam releases the thumb turn 40 manipulating where the thumb turn may be extended radially where the lug nests in the slot 60 of the inner disk 58. Thus, the thumb turn, again, is directly linked for rotation with the drive cam.

The embodiments of the invention described herein can be non-handed. Where the drive cam includes a second orthogonally disposed tailpiece receiving aperture (slot, semicircle, etc) the particular orientation of the door (right hand/left hand) is of no importance so long as the slot in the Drive Cam is properly aligned.

The invention contemplates retrofitting existing deadbolt assemblies. It should be readily apparent that the invention herein is easily adapted to retrofit to existing deadbolt structures such as those described in Oliver U.S. Pat. No. 4,315,420, Schlage U.S. Pat. No. 4,028,917, and Biscoff U.S. Pat. No. 4,228,669. The particulars of the deadbolt lock may be altered in order to adapt to other off-the-shelf deadbolts and structures. The invention can be adapted to other available conventional deadbolt systems such as those available from Schlage Inc., Mas-Hamilton, Medeco, Inc., Kwikset Inc., etc.

It should be appreciated that the invention is not limited to the specific, illustrated, deadbolt constructions. The invention may also feature status indicators supplemental to the relative position of the thumb turn 40. For example, a lighted/phosphorescent status indicator may be used. Likewise the addition of a long-lasting luminescent material, an LED powered by a small lithium battery, or some other self-viewable visual indicator would aid in determining the status in the dark or an emergency. This will help the owner to find the key-way in the dark without scratching the paint surface.

The invention is also adaptable to cylindrical deadbolt locksets. This is a lockset with a standard spring latch and deadbolt that may incorporate lever type handles which are particularly useful in the case of the physically impaired. Correspondingly, the invention may be adapted for use with solenoid-actuated deadbolts and the like.

Given the foregoing, it should be apparent that the specific described embodiments are illustrative and not intended to be limiting. Furthermore, variations and modifications to the invention should now be apparent to a person having ordinary skill in the art. These variations and modifications are intended to fall within the scope and spirit of the invention as defined by the following claims.

I claim:

1. In combination, a dual cylinder deadbolt with a reciprocating deadbolt latch for mounting through a door having an interior door surface and an exterior door surface, said deadbolt comprising an interior conical outer cylinder cover surrounding a key actuated interior cylinder and a dual cylinder dead bolt adjunct permitting selective keyless operation where said adjunct includes a radially projecting thumb turn and is interposed between the interior door surface and the interior conical outer cylinder cover.

2. The deadbolt adjunct according to claim 1 further including an indicator for indicating the status of the adjunct.

3. The deadbolt adjunct according to claim 1 where the deadbolt latch reciprocates relative to the adjunct and further including a tailpiece projecting into the dead bolt for reciprocating deadbolt latch.

4. The deadbolt adjunct according to claim 1 where the thumb turn is spring biased to project radially outward.

5. The deadbolt adjunct according to claim 1 further including a key which maybe inserted into the key actuated interior cylinder.

6. The deadbolt adjunct according to claim 5 where the thumb turn may be moved to disable and prevent the deadbolt from being locked.

* * * * *